US009334865B2

(12) United States Patent
Johnson et al.

(10) Patent No.: US 9,334,865 B2
(45) Date of Patent: May 10, 2016

(54) SELF-ALIGNING AND VIBRATION DAMPING BEARINGS IN A SUBMERSIBLE WELL PUMP

(71) Applicant: Baker Hughes Incorporated, Houston, TX (US)

(72) Inventors: Nicholas Daniel Johnson, Claremore, OK (US); Arturo Luis Poretti, Claremore, OK (US); Kevin R. Bierig, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/693,230

(22) Filed: Apr. 22, 2015

(65) Prior Publication Data

US 2015/0226219 A1 Aug. 13, 2015

Related U.S. Application Data

(63) Continuation-in-part of application No. 14/022,329, filed on Sep. 10, 2013, now abandoned.

(51) Int. Cl.

| | |
|---|---|
| ***F04D 1/06*** | (2006.01) |
| ***F04D 13/10*** | (2006.01) |
| ***F04D 29/041*** | (2006.01) |
| ***F04D 29/66*** | (2006.01) |

(52) U.S. Cl.

CPC *F04D 1/06* (2013.01); *F04D 13/10* (2013.01); *F04D 29/0413* (2013.01); *F04D 29/669* (2013.01); *F05D 2230/642* (2013.01); *F05D 2300/501* (2013.01)

(58) Field of Classification Search

CPC ..... F04D 13/08–13/086; F04D 25/0686; F04D 29/04–29/059

See application file for complete search history.

(56) References Cited

U.S. PATENT DOCUMENTS 1,662,601 A * 3/1928 Demchuk ..... F16D 23/14 192/110 B
3,062,598 A * 11/1962 Summers ..... F16C 17/06 384/224

(Continued)

FOREIGN PATENT DOCUMENTS

JP EP 1371670 A1 * 12/2003 ..... C08F 8/42

OTHER PUBLICATIONS

AST; Technical Information Sheet, Document No. ENG-04-0655 REV. A, 2012 p. 1.*

(Continued)

*Primary Examiner* — Nathan J Newhouse
*Assistant Examiner* — Thomas Cash
(74) *Attorney, Agent, or Firm* — Bracewell LLP

(57) ABSTRACT

An electrical submersible pump assembly has a centrifugal pump with stages, each having an impeller and a diffuser. A shaft extending from an electrical motor rotates the impellers. In the stages, a thrust runner is coupled to the shaft for rotation in unison. A bushing is non rotatably mounted in a receptacle in the diffuser. The bushing has a bore that receives the body of the runner in sliding, rotating engagement. The bushing has a thrust receiving end engaged by the thrust face of the runner in rotating, sliding engagement to transfer thrust from the runner to the diffuser. An elastomeric compliant member between a cylindrical exterior of the bushing and the receptacle allows limited radial movement of the bushing relative to the diffuser.

20 Claims, 4 Drawing Sheets

(56) References Cited

U.S. PATENT DOCUMENTS

| | | | | |
|---|---|---|---|---|
| 4,678,399 | A * | 7/1987 | Vandevier | F04D 29/167 415/104 |
| 5,209,577 | A | 5/1993 | Swatek | |
| 6,068,444 | A | 5/2000 | Sheth | |
| 6,091,175 | A | 7/2000 | Kinsinger | |
| 7,575,413 | B2 * | 8/2009 | Semple | F04D 1/063 384/275 |
| 7,987,913 | B2 | 8/2011 | Parmeter et al. | |
| 2010/0078177 | A1 * | 4/2010 | Parmeter | E21B 43/128 166/369 |
| 2012/0263610 | A1 | 10/2012 | Tetzlaff et al. | |
| 2013/0315517 | A1 * | 11/2013 | Tetzlaff | F04D 13/08 384/226 |
| 2015/0023815 | A1 | 1/2015 | Tetzlaff et al. | |

OTHER PUBLICATIONS

Wong, KwongVoon; Control Leaks with Bearing Isolators, Jun. 22, 2011, Design World.com retrieved from waybackmachine.org on Jul. 2, 2011.*

* cited by examiner

SELF-ALIGNING AND VIBRATION DAMPING BEARINGS IN A SUBMERSIBLE WELL PUMP

CROSS REFERENCE TO RELATED APPLICATION

This application is a continuation-in-part of Ser. No. 14/022,329, filed Sep. 10, 2013.

FIELD OF THE DISCLOSURE

This disclosure relates in general to electrical submersible pumps for wells and in particular to bearings in the pump assemblies that have self-aligning features as well as vibration damping.

BACKGROUND

Electrical submersible pumps (ESP) are widely used to pump oil production wells. A typical ESP has a rotary pump driven by an electrical motor. A seal section is located between the pump and the motor to reduce the differential between the well fluid pressure on the exterior of the motor and the lubricant pressure within the motor. A drive shaft, normally in several sections, extends from the motor through the seal section and into the pump for rotating the pump. The pump may be a centrifugal pump having a large number of stages, each stage having an impeller and diffuser.

During operation, the impellers create thrust, which can be both in downward and upward directions. The impellers transmit the thrust in various manners to the diffusers. Some pumps are particularly used in abrasive fluid environments. In those pumps, an abrasion resistant thrust runner may be coupled to the shaft to receive thrust from one or more impellers. A bushing may be secured into a receptacle in the diffuser to transfer the thrust. The thrust runner and the bushing may be formed of an abrasion resistant material such as tungsten carbide, that is harder than the material of the diffuser. The bushing is commonly installed in the receptacle with a press fit.

Damage and misalignment may occur when the hard metal bushing is press fit into the diffuser. The wear resistant bushing may misalign slightly when pressed into the bearing carrier. Load concentrations may occur, causing the brittle carbide material to crack. Some pumps tend to vibrate, particularly at higher fluid flow pressures, and the vibration can lead to carbide chattering and cracking.

An electrical submersible pump assembly has a plurality of modules, including a rotary pump module, a motor module, and a seal section module located between the motor module and the pump module. A bearing in at least one of the modules has a sleeve coupled to a drive shaft in said one of the modules for rotation therewith. A bushing has a bore that receives the sleeve in sliding, rotational engagement. A stationarily mounted supporting member has a receptacle that receives the bushing. The supporting member is of a material having less hardness than the material of the bushing. The bushing has an exterior portion of smaller diameter than a portion of the receptacles defining an annular gap. An elastomeric radial compliant member in the gap allows limited radial movement of the bushing relative to the supporting member. For axial compliance, the bushing is free to move axially a limited amount relative to the receptacle.

A key and keyway arrangement may be between the bushing and the supporting member for preventing rotation of the bushing relative to the supporting member. The key and keyway arrangement may include a key integrally formed on the bushing and a slot in the receptacle.

The radial compliant member may comprise at least two elastomeric rings. Alternately, the compliant member may comprise a layer of elastomeric material bonded to the bushing and to the receptacle.

A resilient axial compliant member may be positioned to urge the bushing upward relative to the receptacle. In one embodiment, the axial compliant member comprises an elastomeric ring. In another embodiment, the layer of elastomeric material extends between a thrust receiving shoulder of the receptacle and the bushing to serve as an axial compliant member.

The pump may be a centrifugal pump having a plurality of stages, each of the stages having an impeller and a diffuser, with the bearing being located in at least one of the stages. The sleeve in that instance composes a thrust runner that receives thrust from the impeller of one of the stages and has a thrust transferring face in engagement with a thrust receiving end of the bushing. The bushing has a thrust transferring surface that engages a thrust receiving shoulder in the receptacle of said one of the stages. The supporting member comprises a diffuse, or it could be a bearing spacer.

DETAILED DESCRIPTION OF THE DISCLOSURE

Figure 1:
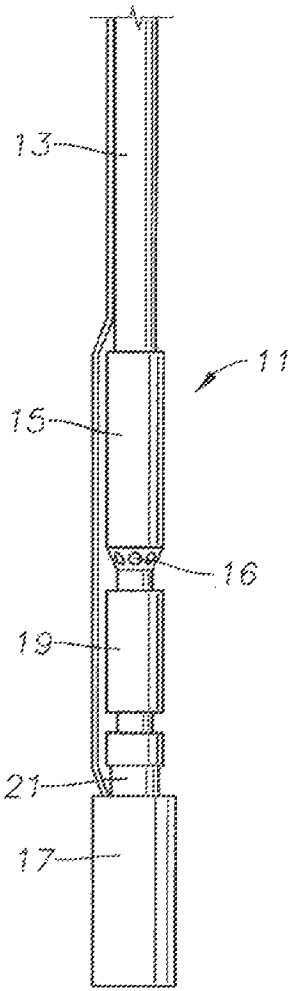
FIG. 1 is a side view of an electrical submersible pump assembly in accordance with this disclosure.

Referring to FIG. 1, electrical submersible pomp assembly (ESP) 11 is illustrated as being supported ob production tubing 13 extending into a well. Alternately, ESP 11 could be supported by other structure, such as coiled tubing. ESP 11 includes several modules, one of which is a rotary pump 15 that is illustrated as being a centrifugal pump. Pump 15 has an intake 16 for drawing in well fluid. Another module is an electrical motor 17, which drives pump 15 and is normally a three-phase AC motor. A third module comprises a protective member or seal section 19 coupled between pump 15 and motor 17. Seal section 19 has components to reduce a pressure differential between dielectric lubricant contained in motor 17 and the pressure of the well fluid on the exterior of ESP 11. Intake 16 may be located in an upper portion of seal section 19 or on a lower end of pump 15. A thrust bearing 21 for motor 17 may be in a separate module or located in seal section 19 or motor 17.

ESP 11 may also include other modules, such as a gas separator ice separating gas from the well fluid prior to the well fluid flowing into pump 15. The various modules may be shipped to a well site apart from each other, then assembled with bolts or other types of fasteners.

Figure 2:
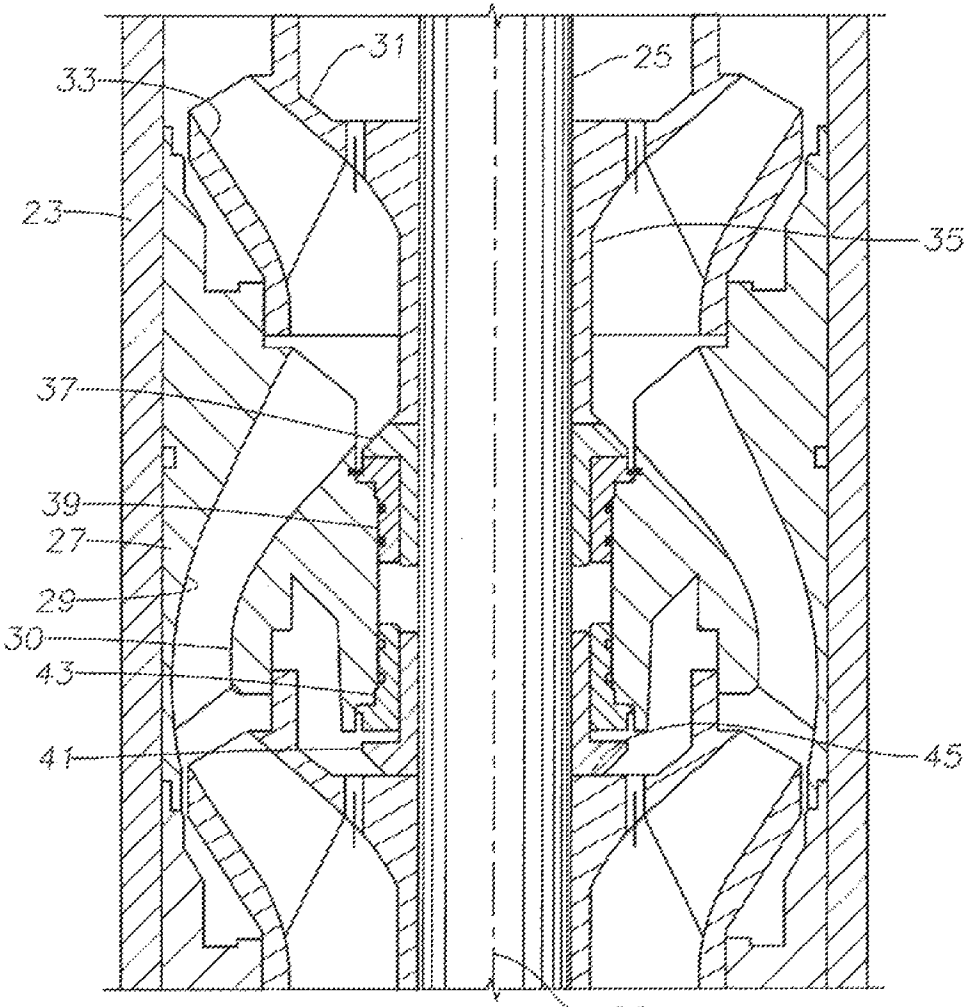
FIG. 2 is a sectional view of a portion of the pump of the pump assembly of FIG. 1.

Referring to FIG. 2, pump 15 includes a housing 23 that is cylindrical and much longer than its diameter. A drive shaft 25 extends along longitudinal axis 26 through housing 23 and is rotated by motor 17. Shaft 25 is normally made up of several sections connected together with splined ends. A large number of stages are normally within housing 23, each stage including a stationary diffuse 27. Diffusers 2 are stacked on one another and secured against rotation in housing 23. Diffusers 27 have flow passages 29 leading upward and inward toward axis 26. An impeller 31 is rotatably located within a central receptacle 30, which is a part of each diffuser 27. Impellers 31 have low passages 33 that lead fro a central area upward and outward from axis 26. The terms "downward" and "upward" and used only for convenience, since pump 15 is not always oriented vertically as shown. The example of FIG. 2 is a mixed flow type, wherein the flow passages 29, 33 extend both axially as well as radially. Alternately, pump 15 could be a radial flow type wherein the flow passages extend primarily radially and not axially.

FIG. 2 illustrates how thrust imposed on each impeller 31 is transferred to one of the diffusers 27, which serves as a supporting member. When pump 15 is pumping fluid, the thrust may be in a downward direction away from the overall direction the fluid is being pumped. Upward directed thrust can also occur, during normal operation. Each impeller 31 has a hub 35, which is a cylindrical member having a bore through which shaft 25 passes. In this example, a thrust runner or sleeve 37 is located below hub 35. The lower end of hub 35 abuts an upper end of thrust runner 37. Alternately, a spacer sleeve (not shown) could be located between thrust runner 37 and hub 35. Also, rather than being separate as shown, hub 35 and thrust runner 37 could be integrally formed together. Further, thrust runners 37 could be employed with only part of the impellers 31, rather than all, as shown. That is, hubs 35 could transfer thrust from one impeller 31 to another impeller 31 and eventually to thrust runner 37. Thrust runner 37 may be of a harder material than the material of impeller hub 35, such as tungsten carbide.

Thrust runner 37 seats in a thrust bushing 39, which in turn is nonrotatably supported in diffuse receptacle 30. FIG. 2 shows an optional upthrust thrust runner 41, which is an inverted image of downthrust runner 37. Upthrust runner 41 has a lower end that abuts an upper end 45 of impeller 31. Upthrust runner 41 seats in an upthrust bushing 43, which in turn is non rotatably supported in diffuser receptacle 30. Runners 37, 41 are secured to shaft 25 for rotation but are free to move a limited amount axially relative to shaft 25. Typically a key (not shown) engages mating axially extending grooves in runners 37, 41 and shaft 25.

Figure 3:
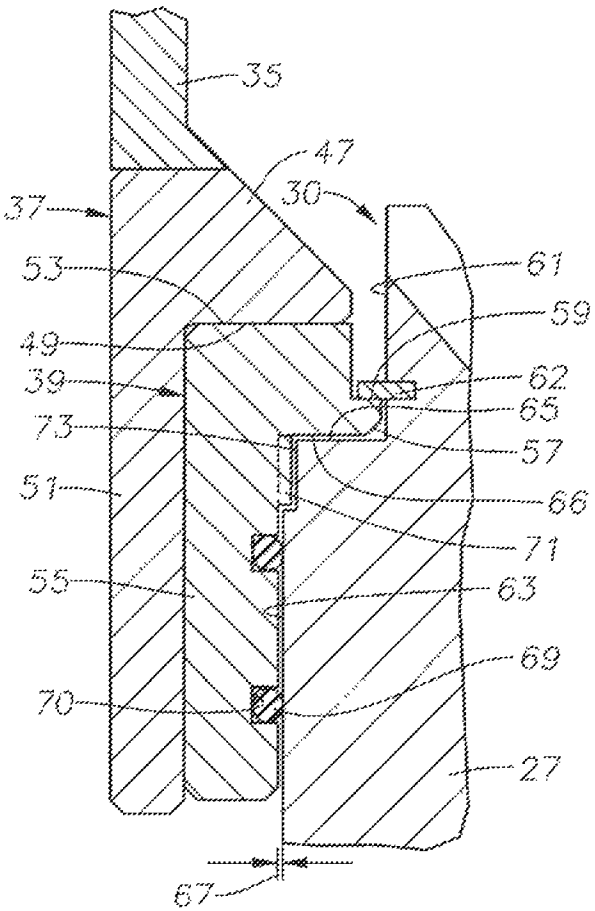
FIG. 3 is an enlarged sectional view of one of the thrust runners and bushings of the pump of FIG. 2 and shown installed in a diffuser.

Referring to FIG. 3, in a first embodiment, thrust runner 37 has a radially extending flange 47 on its upper end. The upper side of flange 4 may be conical with the maximum diameter at the lower edge of flange 47. Flange 47 has on its lower side a thrust transferring face 49 that is illustrated as being in a plane perpendicular to axis 26 (FIG. 2) and facing in a downward direction. Thrust transferring face 49 may alternately be conical. A cylindrical body 51 extends downward from thrust transferring face 49 and has a smaller outer diameter than flange 47. Bushing 39 has a flat thrust receiving surface 53 on its upper end that is engaged by thrust transferring face 49 in rotating, sliding contact.

Bushing 39 has a cylindrical body 55 with a radially extending flange 57 at its upper end. In this example, the maximum outer diameter of bushing flange 57 is slightly greater than the maximum outer diameter of runner flange 47. Bushing body 55 has a smaller outer diameter than the outer diameter of bushing flange 57. Bushing flange 57 is shown in FIG. 3 as having an upward facing retaining shoulder 59 extending radially outward. Retaining shoulder 59 is at an elevation lower and has a greater outer diameter than bushing thrust receiving surface 53.

Diffuse receptacle 30 has an upper bore section 61 into which bushing flange 57 extends. A retaining ring 62, such as a split ring, fits into a groove in upper bore section 61 and extends over bushing retaining shoulder 59 at a distance selected to allow limited, axial movement of bushing 39 relative to receptacle 30. Diffuse receptacle 30 has a lower bore section 63 extending downward from upper bore section 61 and being of a smaller inner diameter. The difference in diameters between lower bore section 63 and upper bore section 61 results in an upward facing thrust receiving shoulder 65. Bushing flange 57 has a flat lower side or thrust transferring surface 66 that is in engagement with thrust receiving shoulder 65 to transmit downward directed thrust. In the FIG. 3 embodiment, retaining ring 62 and receptacle shoulder 66 allow limited axial movement of bushing 39 relative to diffuser 27. When in a lower position, bushing shoulder 66 will contact thrust receiving shoulder 65 to transfer downward directed thrust.

The cylindrical exterior of runner body 51 is only slightly less in diameter than the bore of bushing 39. The cylindrical exterior of bushing body 55 is significantly less in diameter than the inner diameter of receptacle lower bore section 63. The difference in diameter results in an annular gap 67 that is exaggerated in the drawings. Annular gap 6 can be either greater than or less than the clearance between the outer diameter of thrust runner body 51 and the inner diameter of bushing 39.

A resilient, radial compliant member locates in annular gap 67, and in FIGS. 3-6, it comprises a pair of elastomeric rings 69 axially spaced apart from each other. Compliant rings 69 may be located in mating grooves 70, which may be either in bushing 39, as shown, or in receptacle lower bore section 63. Compliant rings 69 allow some radial movement of bushing 39 relative to diffuser 27. Compliant rings 69 also form a seal between bushing 39 and diffuser 27 and may be O-rings. Compliant rings 69 may be formed of an absorptive material and coated with oil prior to installation. After installation, complaint rings 69 absorb the oil and expand to create a tighter engagement with diffuser 27.

Figure 4:
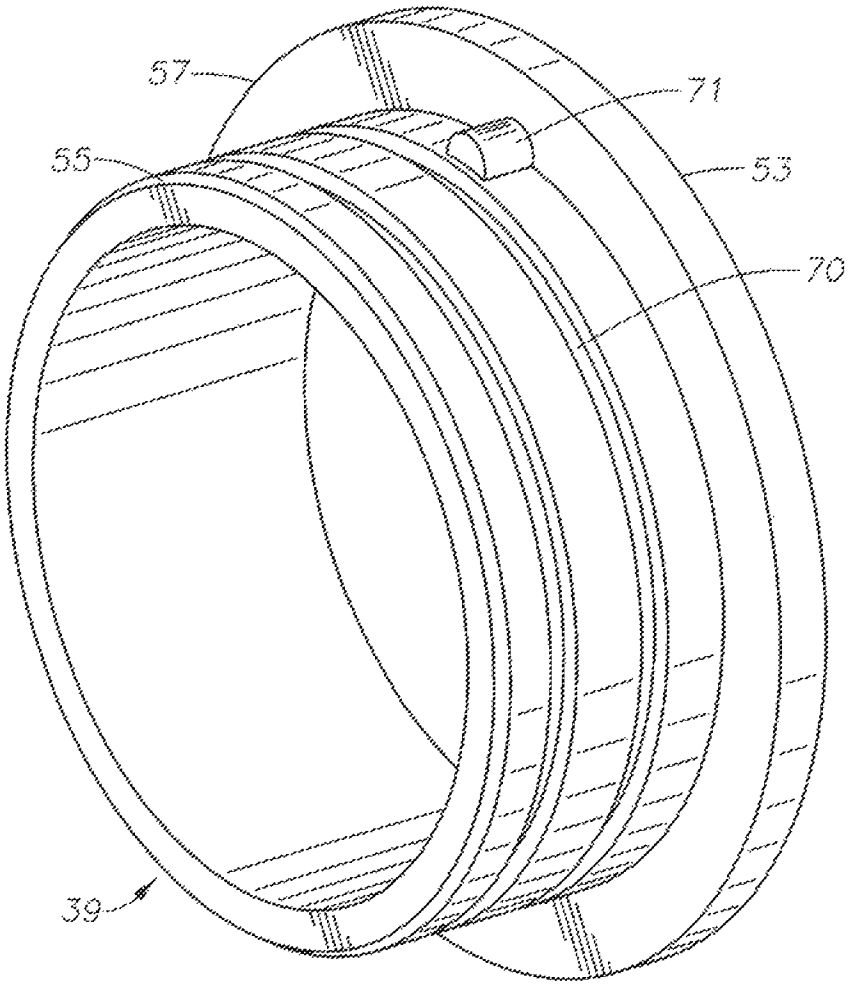
FIG. 4 is an isometric view of the thrust runner shown in FIG. 3.

Bushing 39 and diffuser 27 also have an anti-rotation means to prevent rotation of bushing 39 in diffuser 27. For example, the anti-rotation means may comprise a keyway and key arrangement. Key 71 is illustrated in FIG. 4 as being a lug integrally formed on the outer diameter of bushing body 55. A mating axially extending slot 73 is formed in receptacle lower bore section 63.

Upthrust runner 41, upthrust bushing 43 and the lower portion of diffuser receptacle 30 may be the same as shown in FIG. 3, except inverted. In the operation of the embodiment of FIGS. 1-4, motor 17 rotates shah 25, causing impellers 31 to rotate. The pump stages pump well fluid through impeller flow passages 33 and diffuser flow passages 29. Downward test imposed on impellers 31 passes through impeller hubs 35 to thrust runners 37, which are in rotating engagement with stationary thrust bushings 39. The downward thrust passes from bushings 39 to diffuser receptacle shoulders 65. Compliant rings 69 allow slight radial movement of bushings 39 relative to diffuser receptacles 30. The radial movement helps bushings 39 align with runners 37 and dampens vibration.

Figure 5:
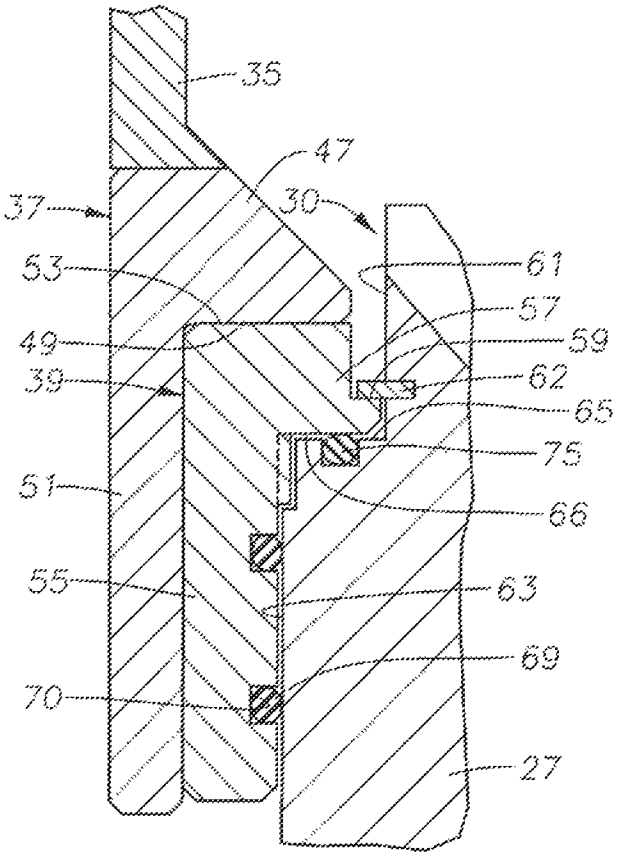
FIG. 5 is a sectional view of a first alternate embodiment of the thrust runner and bushing of FIG. 2.

FIG. 5 illustrates a second embodiment. The components that are the same as FIG. 3 have the same numerals. In this second embodiment, a resilient axial compliant ring 75 is employed in addition to urge bushing 39 upward relative to diffuser 27. Axial compliant ring 75 is of a resilient energy absorbing material located between, bushing thrust transferring surface 66 and receptacle thrust receiving shoulder 65. In the example shown, axial compliant ring 75 is an elastomeric ring. Axial compliant ring 75 is within a groove that may be either in thrust receiving shoulder 65, as shown, or in thrust transferring surface 66. As in FIG. 3, retaining ring 62 is positioned to allow slight axial movement of bushing 39 relative to receptacle 30. The axial movement enhances the ability of bushing 39 to align with runner 37. Axial compliant ring 75 urges thrust transferring surface 66 away from receptacle thrust receiving shoulder 65.

Figure 6:
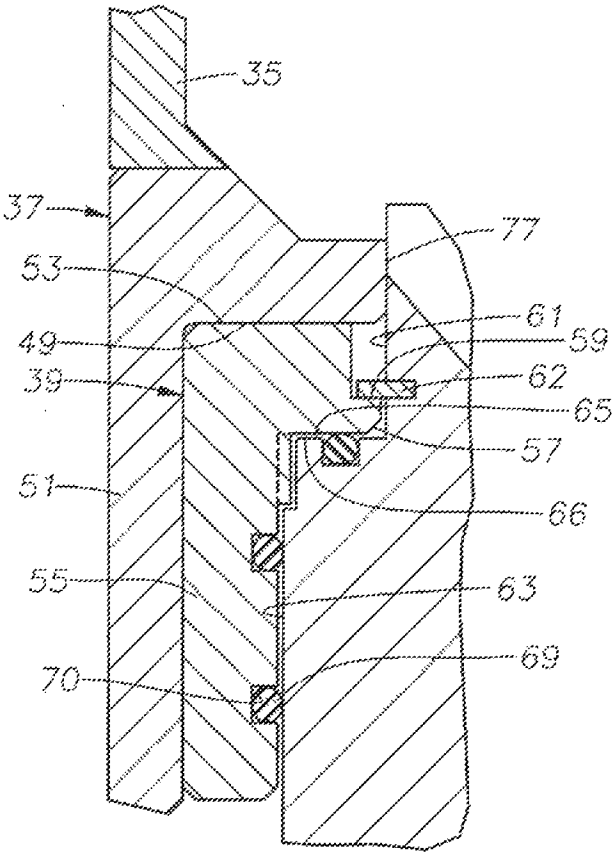
FIG. 6 is a sectional view of a second alternate embodiment of the thrust runner and bushing of FIG. 2.

FIG. 6 illustrates a third embodiment wherein an axial compliant ring 75 is optionally used, as well. In this embodiment, runner flange 77 extends radially outward to a greater extent than runner flange 47 in FIGS. 3 and 5. Runner flange 77 has an outer diameter that is only slightly less than the inner diameter of receptacle upper bore section 61. In FIGS. 3 and 5, runner flange 47 has an outer diameter that is considerably less than the inner diameter of upper bore section 61. The gap between the outer diameter of runner flange 77 and the inner diameter of receptacle upper bore section 61 is at least equal to the annular gap between the outer diameter of bushing body 55 and diffuser lower bore portion 63. In FIG. 4 the outer diameter of runner flange 77 is approximately the same as the outer diameter of bushing retaining shoulder 59, thus runner flange 77 extends over retaining shoulder 59. Also, the upper side of runner flange 77 may have a flat margin at its outer diameter, rather than being entirely conical as in FIGS. 3 and 5. The purpose of the extended flange 77 is to create a hydraulic seal between flange 77 and receptacle upper bore section 61. The hydraulic seal further reduces the ability of debris to became lodged between bushing 39 and diffuser receptacle 30.

Figure 7:
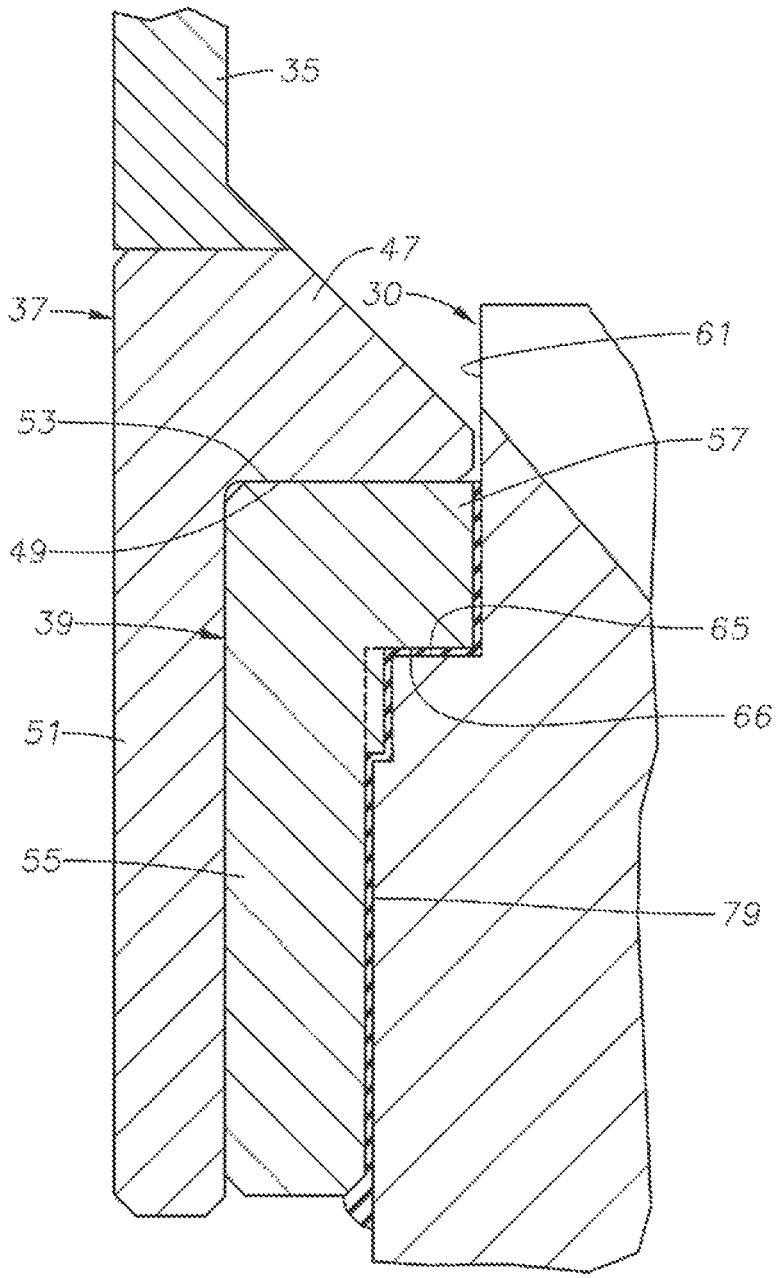
FIG. 7 is a sectional view of a third alternate embodiment of the thrust runner and bushing of FIG. 2.

In the embodiment of FIG. 7, annular gap 67 is filled with a layer 79 of compliant material, rather than elastomeric rings 69, 75. Compliant layer 79 extends the full length of bushing 39 from the lower end to the upper end. A portion of compliant layer is located, between flange lower side 66 and receptacle thrust receiving shoulder 65, providing axial compliance. Preferably, complaint layer 79 is cured in place between, bushing 39 and receptacle 30, thereby bonding bushing 39 to receptacle 30. Compliant layer 79 thus creates a seal between diffuser receptacle 30 and bushing 39. The bonding of compliant layer 79 limits axial movement of bushing 39 in receptacle 30, thus retaining ring 62 (FIGS. 3 and 5, 6) is not required. Optionally, anti-rotation key 71 and slot 73 could be eliminated, with the bonded compliant layer 79 serving as an anti-rotation means.

While the disclosure has been shown in only a few of its forms, it should be apparent to those skilled in the art that it is not so limited but is susceptible to various changes without departing from the scope of the disclosure. For example, although shown only in connection with a pump stages, the complaint bushing could also be employed with shaft bearings in the pump, seal section, motor, and gas separator, if used. In addition the downthrust flange of the bushing could be a separate member from the body portion of the bushing.

The invention claimed is:

1. An electrical submersible pump assembly, comprising:

a plurality of modules, including a centrifugal pump module, a motor module, and a seal section module located between the motor module and the pump module;

a plurality of stages in the pump module, each of the stages having an impeller and a diffuser and comprising:

a thrust runner coupled to a drive shaft in the pump module for rotation therewith, the thrust runner having an exterior cylindrical portion, an upward facing thrust receiving surface for receiving down thrust from the impeller and a downward facing thrust transferring surface;

a bushing having a bore that receives the cylindrical portion of the sleeve in sliding, rotational engagement, the bushing having an upward facing thrust receiving surface for receiving down thrust from the thrust transferring surface of the thrust runner, the bushing having a downward facing thrust transferring surface;

a receptacle in the diffuser that receives the bushing, the receptacle being of less hardness than the bushing, the receptacle having an upward facing thrust receiving surface;

the bushing having a cylindrical exterior portion of smaller diameter than a portion of the receptacle, defining an annular gap;

a layer of elastomeric material bonded between the cylindrical exterior portion of the bushing and the receptacle and between the thrust transferring surface of the bushing and the thrust receiving surface of the receptacle.

2. The pump assembly according to claim 1, further comprising:

a key and keyway arrangement between the bushing and the receptacle for preventing rotation of the bushing relative to the receptacle.

3. The pump assembly according to claim 2, wherein the key and keyway arrangement comprises a key integrally formed on the bushing and a slot in the receptacle.

4. The pump assembly according to claim 1, wherein:

the receptacle has a larger diameter section extending upward from the thrust receiving surface and being of larger diameter than a portion of the receptacle below the thrust receiving surface;

the bushing further comprises:

an external flange at an upper end of the bushing and located in the larger diameter section of the receptacle, the thrust receiving surface of the runner being on an upper side of the flange and the thrust transferring surface of the runner being on a lower side of the flange, the flange having a cylindrical periphery; and the layer of elastomeric material is also bonded between the cylindrical periphery of the flange and the larger diameter section of the receptacle.

5. The pump assembly according to claim 1, wherein the layer of elastomeric material extends continuously from a lower end of the bushing to the thrust receiving surface of the bushing.

6. The pump assembly according to claim 4, wherein:

the thrust transferring surface of the thrust runner is located on a lower side of an external flange of the thrust runner; and the flange of the thrust runner has an outer diameter substantially the same as an outer diameter of the flange of the bushing.

7. The pump assembly according to claim 1, wherein:

the layer of elastomeric material allows limited radial movement of the bushing relative to the receptacle and limited axial movement of the bushing relative to the receptacle.

8. An electrical submersible pump assembly, comprising:

a centrifugal pump having a plurality of stages, each of the stages having an impeller and a diffuser, and a driven shaft that rotates the impellers;

an electrical motor that rotates the driven shaft;

a seal section coupled between the pump and the motor for reducing a pressure differential between lubricant in the motor and well fluid on an exterior of the motor;

at least one of the stages comprising:

a thrust runner coupled to the shaft for rotation therewith, the runner having a downward facing thrust face transverse to an axis of the shaft and a body with a cylindrical exterior, the runner having an upward facing thrust receiving end positioned to receive down thrust from the impeller of said at least one of the stages;

a cylindrical receptacle in the diffuser, the receptacle having an upward facing thrust receiving shoulder at an upper end of the receptacle;

a bushing having a cylindrical exterior non rotatably mounted in the receptacle in the diffuser of said at least one of the stages, the bushing having a bore that receives the body of the runner in sliding, rotating engagement, the bushing having an external flange extending radially outward from the cylindrical exterior with a thrust receiving upper side engaged by the thrust face of the runner in rotating, sliding engagement, the flange of the bushing having a thrust transferring lower side in engagement with the shoulder of the receptacle to transfer down thrust from the runner to the diffuser, an elastomeric radial compliant member between a cylindrical exterior of the bushing and the receptacle to allow limited radial movement of the bushing relative to the diffuser;

an elastomeric compliant member between the shoulder of the receptacle and the lower side of the flange of the bushing; and wherein the bushing is axially movable relative to the receptacle a limited amount.

9. The pump assembly according to claim 8, the elastomeric axial compliant member and the elastomeric radial compliant member comprise a continuous elastomeric layer extending from a lower end of the bushing to the thrust receiving upper side of the bushing, the layer being bonded between the bushing and the receptacle.

10. The pump assembly according to claim 8, further comprising:

a key and keyway arrangement between the bushing and the receptacle to prevent rotation of the bushing relative to the diffuser.

11. The pump assembly according to claim 8, wherein the bushing is formed of a harder material than the material of the diffuser.

12. The pump assembly according to claim 8, further comprising:

an axially extending slot in the receptacle; and a key integrally formed on the cylindrical exterior of the bushing that is located in the slot to prevent rotation of the bushing relative to the diffuser.

13. The pump assembly according to claim 8, further comprising:

a retaining shoulder on the flange of the bushing; and a split retaining ring located in a mating recess in the receptacle and engaging the retaining shoulder, the retaining ring being positioned to allow limited axial movement of the bushing relative to the diffuser.

14. The pump assembly according to claim 8, wherein:

the radial compliant member comprises a pair of axially spaced apart elastomeric rings; and the axial compliant member comprises an elastomeric ring.

15. The pump assembly according to claim 8, further comprising:

an upper bore section extending axially upward from the shoulder of the receptacle; and wherein the thrust runner has a flange that extends radially outward farther than the flange of the bushing to form a hydraulic seal with the upper bore section.

16. The pump assembly according to claim 8, wherein:

the radial compliant member comprises a cylindrical layer of elastomeric material between and bonded between the cylindrical exterior of the bushing and the receptacle, the cylindrical layer extending an axial length of the cylindrical exterior of the bushing; and the axial compliant member comprises a flat layer of elastomeric material between and bonded to the lower side of the flange of the bushing and the shoulder of the diffuser.

17. An electrical submersible pump assembly, comprising:

a centrifugal pump having a plurality of stages, each of the stages having an impeller and a diffuser, and a driven shaft that rotates the impellers;

an electrical motor that rotates the driven shaft;

a seal section coupled between the pump and the motor for reducing a pressure differential between lubricant in the motor and well fluid on an exterior of the motor, at least one of the stages comprising:

a receptacle formed in the diffuser of said at least one of the stages, the receptacle having an upward facing thrust receiving shoulder, defining a smaller diameter bore section below the thrust receiving shoulder and a larger diameter bore section above the thrust receiving shoulder, a thrust runner coupled to the shaft for rotation therewith, the runner having a body with a cylindrical exterior, an upward facing thrust receiving end on the body in engagement with the impeller of said one of the stages, a flange extending radially outward from the body and having a downward facing thrust transferring face;

a bushing having a bore that receives the cylindrical exterior of the body of the runner in sliding, rotating engagement, the bushing having an upward facing thrust receiving surface engaged by the thrust transferring face in rotating, sliding engagement to transfer thrust from the runner to the diffuser, the bushing having a flange with a downward facing thrust transferring surface that engages the thrust receiving shoulder in the receptacle and is located in the larger diameter bore section of the receptacle, the bushing having a cylindrical exterior portion that locates within the smaller diameter bore section of the receptacle, the bushing have a greater hardness than the diffuser, an elastomeric radial compliant member between the cylindrical exterior portion of the bushing and the smaller diameter bore section of the receptacle to allow limited radial movement of the bushing relative to the diffuser, and an elastomeric axial compliant member between the thrust receiving shoulder in the receptacle and the flange of the bushing to allow limited axial movement of the bushing relative to the diffuser.

18. The pump assembly according to claim 17, wherein the radial compliant member and the axial compliant member comprise a continuous layer of elastomer bonded between the bushing and the receptacle, the layer of elastomer extending from a lower end of the bushing to the thrust receiving surface of the bushing.

19. The pump assembly according to claim 17, further comprising:

a key and slot arrangement between the bushing and the receptacle to prevent rotation of the bushing relative to the diffuser.

20. The pump assembly according to claim 17, further comprising:

an upward facing retaining ring shoulder on the flange of the bushing below and extending radially outward from the thrust receiving surface of the bushing; and a split retaining ring located in a mating recess in the larger diameter bore section of the receptacle and engaging the retaining ring shoulder, the retaining ring being positioned to allow limited axial movement of the bushing relative to the diffuser.

* * * * *